US005128080A

United States Patent [19]

Jurewicz et al.

[11] Patent Number: 5,128,080

[45] Date of Patent: Jul. 7, 1992

[54] METHOD OF FORMING DIAMOND IMPREGNATED CARBIDE VIA THE IN-SITU CONVERSION OF DISPERSED GRAPHITE

[75] Inventors: Stephen R. Jurewicz; Timothy W. Hurst, both of Houston, Tex.

[73] Assignee: Hughes Tool Company, Houston, Tex.

[21] Appl. No.: 575,134

[22] Filed: Aug. 30, 1990

[51] Int. Cl.[5] ..... C04B 35/56

[52] U.S. Cl. ..... 264/56; 264/60; 423/446

[58] Field of Search ..... 423/446, 460; 51/307; 419/11; 428/408, 698; 264/60, 62; 265/56

[56] References Cited

U.S. PATENT DOCUMENTS

| | | | |
|---|---|---|---|
| 3,334,968 | 8/1967 | Ishizuka | 423/446 |
| 3,850,053 | 7/1974 | Bovenkerk | 51/307 |
| 4,036,937 | 7/1977 | Roy et al. | 423/446 |
| 4,089,933 | 5/1987 | Vereschagin et al. | 423/446 |
| 4,259,090 | 3/1981 | Bovenkerk | 51/309 |
| 4,260,397 | 4/1981 | Bovenkerk | 423/446 |
| 4,273,561 | 6/1981 | Fernandez-Moran Villalobos | 51/307 |
| 4,412,980 | 11/1983 | Tsuji et al. | 423/446 |
| 4,525,178 | 6/1985 | Hall | 51/309 |

FOREIGN PATENT DOCUMENTS

| | | | |
|---|---|---|---|
| 61-031354 | 2/1986 | Japan | 419/11 |
| 1166517 | 12/1969 | United Kingdom | 423/446 |

*Primary Examiner*—Michael Lewis
*Assistant Examiner*—Stuart L. Hendrickson
*Attorney, Agent, or Firm*—Charles D. Gunter, Jr.

[57] ABSTRACT

A method is shown for forming a diamond impregnated carbide containing dispersed diamond crystals, the crystals being formed via in-situ conversion of graphite to diamond. Graphite particles are blended with tungsten carbide power and a binder containing elemental powders known to be diamond catalyst. After blending, the powder is pressed into a green body of a desired shaped and sintered. After sintering, the body is loaded into a high temperature and pressure apparatus and exposed to conditions sufficient to convert the graphite to diamond.

6 Claims, 2 Drawing Sheets

METHOD OF FORMING DIAMOND IMPREGNATED CARBIDE VIA THE IN-SITU CONVERSION OF DISPERSED GRAPHITE

BACKGROUND OF THE INVENTION

1. Field of the Invention

The present invention relates generally to a method for forming a diamond impregnated carbide and specifically to a method for forming a cemented tungsten carbide composite containing dispersed diamond crystals formed via the in-situ conversion of dispersed graphite particles.

2. Description of the Prior Art

A variety of composite polycrystalline diamond bodies are known in the prior art for use as wear resistant and cutting elements. For instance, U.S. Pat. No. 3,850,053 describes a technique for making cutting tool blanks by placing a graphite disk in contact with a cemented tungsten carbide cylinder and exposing both simultaneously to diamond forming temperatures and pressures. U.S. Pat. No. 4, 259,090 describes a technique for making a cylindrical mass of polycrystalline diamond by loading a mass of graphite into a cup-shaped container made from tungsten carbide and diamond catalyst material. The loaded assembly is then placed in a high temperature and pressure apparatus where the graphite is converted to diamond.

U.S. Pat. No. 4,525,178 shows a composite material which includes a mixture of individual diamond crystals and pieces of precemented carbide. The mixture is heated and pressurized to create intercrystalline bonds between the diamond crystals and chemical bonds between the diamond crystals and the precemented carbide pieces.

The prior art reveals methods for making diamond impregnated cemented carbide in which diamond particles are blended with carbide powder and either a hot press or high pressure, high temperature apparatus (HPHT) is used for final sintering. However, such techniques have suffered from several disadvantages, the primary disadvantage being less than optimum diamond retention. U.S. Pat. No. 4,525,178 was an attempt to improve upon the prior art. Instead of blending diamond crystals with a tungsten carbide matrix powder and processing the blend using powder metallurgy technology, chunks of sintered tungsten carbide were ground up and mixed with diamond crystals. The mixture of diamond crystals and precemented carbide chunks was placed into a HPHT apparatus to sinter the materials into a solid composite body. The process was dependant upon forming intercrystalline bonds between diamond crystals and precemented carbide particles. The technique was also limited in the shapes that could be formed because low density green bodies were placed in an HPHT apparatus capable of reaching conditions in excess of 40 kilobars pressure and 1200° C. temperature. The shapes which could be formed were limited to those shapes which could be formed in an HPHT press. It was also not possible to make a composite having a diamond grain size which was on the order of magnitude of the size of the individual carbide grains, since the prior art process employed chunks of precemented carbide as a starting material.

A need exists for an improved method for forming a diamond impregnated carbide in which standard powder metallurgy starting materials are utilized.

A need also exists for an improved method for producing a diamond impregnated carbide which does not rely upon the use of diamond crystals and precemented carbide particles as starting materials.

A need also exists for an improved method for forming a diamond impregnated carbide, the carbide being produced in any of the shapes currently possible with standard tungsten carbide powder technology.

A need also exists for a method for forming a diamond impregnated carbide in which skeletal diamond crystals produced in-situ are intergrown and intertwined with the individual carbide grains.

A need also exists for a method for forming a diamond impregnated carbide suitable for use as a wear resistant pad or cutting structure which has improved abrasion resistance and diamond retention characteristics.

SUMMARY OF THE INVENTION

In the method of forming a diamond impregnated carbide of the invention, a particle blend is formed comprised of an unsintered carbide matrix having excess free carbon added thereto, the carbide matrix being comprised of at least one metal carbide powder combined with a binder including at least one elemental powder or alloy known to be a diamond catalyst. Preferably, the particle blend is comprised of graphite particles which are blended with particles of an unsintered carbide matrix, the unsintered carbide matrix being comprised of at least one metal carbide powder combined with a binder which includes at least one elemental powder or alloy known to be a diamond catalyst. The particle blend is then formed into a green body of a desired shape. Although the green body can be placed directly into an HPHT apparatus, the green body is preferably first sintered to form a sintered body containing graphite particles. The sintered body containing graphite particles is then subjected to temperature and pressure conditions sufficient to convert the graphite to diamond in-situ, as in an HPHT apparatus.

Most preferably, the graphite particles are blended with an unsintered carbide matrix which is comprised of tungsten carbide powder combined with a binder which includes at least one elemental powder known to be a diamond catalyst, the elemental powder being selected from the group consisting of nickel, cobalt, iron and alloys thereof.

The method of the invention can be used to produce a diamond impregnated carbide with improved abrasion resistance and diamond retention properties.

Additional objects, features and advantages will be apparent in the written description which follows.

DETAILED DESCRIPTION OF THE INVENTION

Figure 1:
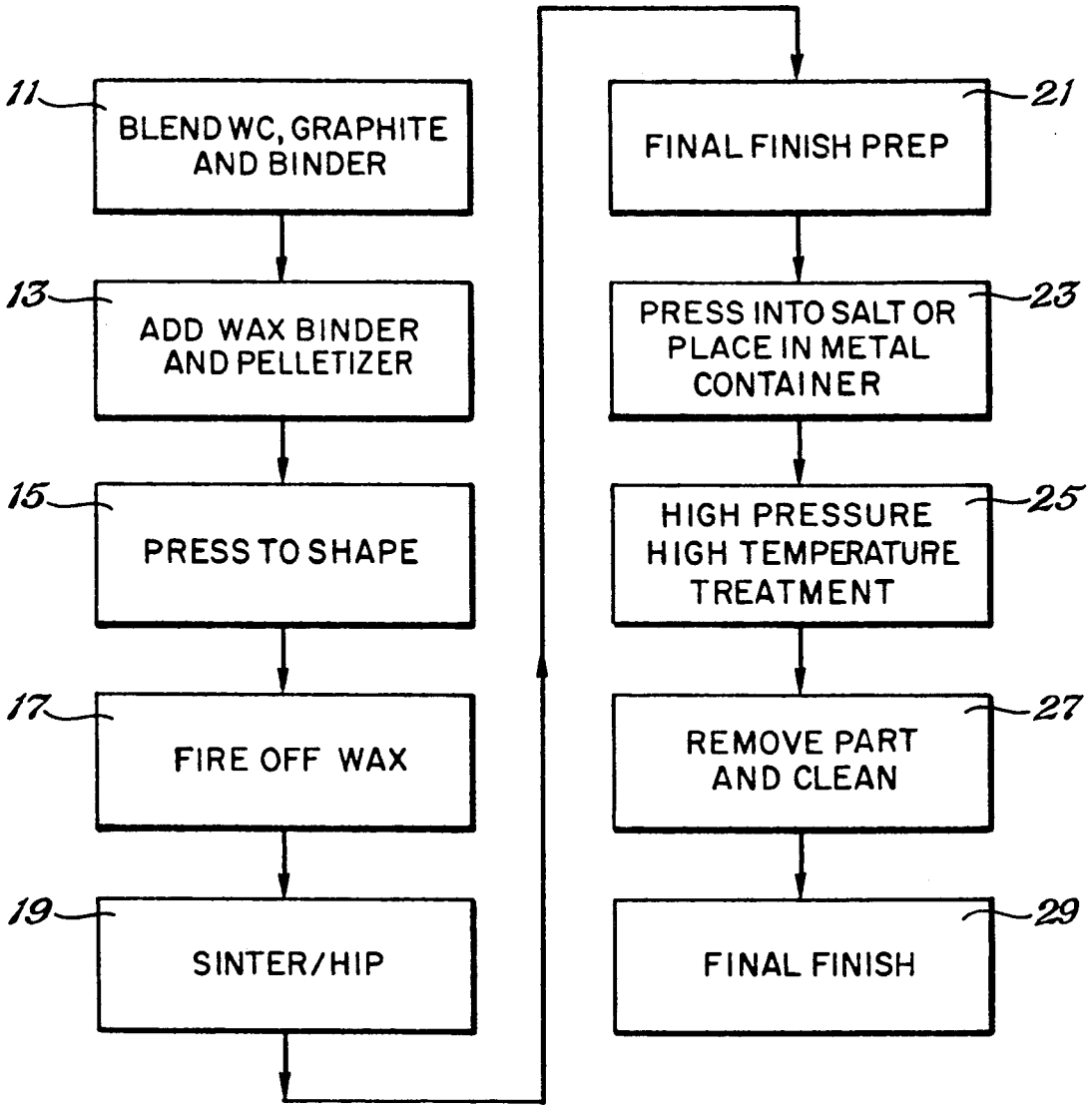
FIG. 1 is a flow diagram showing the steps of the method used to form a diamond impregnated carbide of the invention.

In the first step of the method of the invention, illustrated as 11 in the flow diagram of FIG. 1, a particle blend is first formed comprised of an unsintered carbide matrix having excess free carbon added thereto. Preferably, the carbide matrix is comprised of at least one metal carbide powder combined with a binder including at least one elemental powder or alloy known to be a diamond catalyst. The metal carbide powder can conveniently be selected from carbides of the group consisting of Ti, Zr, Hf, V, Nb, Ta, Cr, Mo, or W. Most preferably, the carbide powder is tungsten carbide, WC.

The binder which is combined with the metal carbide powder will be familiar to those skilled in the powder metallurgy arts and can be a binder such as Ni, Co, Fe, or alloys thereof, or any other element from rows 3, 4, 5 or 6 of the periodic table that is known to be a diamond catalyst.

The source of excess, free carbon can conveniently be natural or synthetic graphite particles or flakes, the graphite preferably having a particle size on the order of 0.2–1000 microns, preferably about 2–10 microns, most preferably about 2–5 microns, the particle size being approximately the same as the particle size of the metal carbide powder selected for use in the particle blend.

The total free carbon content of the particle blend is in the range from about 0.5 to 90% by volume, preferably about 0.5 to 50% by volume, based on the total volume of the particle blend. Higher free carbon contents are thought to inhibit compact pressability and can lead to carbon segregation in many processing steps due to the large density difference between carbon and the other hard metal constituents of the body. The binder is preferably present in the range from about 5 to 50% by volume based on the total volume of the particle blend.

After blending the metal carbide, graphite and binder powders, the powder mixture has a wax added (for instance paraffin or Carbowax) to consolidate the powder blend and the powders are pelletized, using standard powder metallurgy techniques. This step is illustrated as 13 in FIG. 1.

It will be appreciated that in the next step (15 in FIG. 1) of the method, the shapes and sizes of the pelletized bodies used to form the diamond impregnated carbides of the invention can be varied to suit particular applications. After the step of pressing the pellets to shape 15 and firing off the waxes present 17, the green body of desired shape is then sintered in a step 19, preferably using atmospheric, vacuum or HIP sintering. Most preferably, the green body is sintered in a conventional sinter/HIP apparatus or vacuum sintering furnace at about 1400° C. and at about 400 psi of pressure in an argon atmosphere.

The sintered body containing graphite particles is then given any final finishing or shaping which may be desired in a step 21. The sintered body is then placed into a metal container or plated with a protective metal overcoat and then pressed within a salt block in a step 23. The protective metal overcoat can be any pure metal that can be plated onto the sintered body, for instance nickel. Preferably, the sintered body with the protective metal overcoat is encapsulated within ordinary salt, the salt which surrounds the sintered body being used to equalize the force applied to the body in subsequent steps to prevent unwanted deformation of the body.

The body is then loaded into a HPHT apparatus in a step 25 and exposed to conditions sufficient to convert the graphite to diamond. Ultra high pressure and temperature cells are described, for instance, in U.S. Pat. No. 3,913,280, and U.S. Pat. No. 3,745,623 and will be familiar to those skilled in the art. These devices are capable of reaching conditions in excess of 40 kilobars pressure and 1200° C. temperature. The HPHT apparatus converts the graphite in the dense sintered bodies "in-situ" into diamond skeletal crystals with little shape change in the body other than slight shrinkage owing to the conversion process. However, because the original graphite grains are intimately intergrown and intertwined with individual tungsten carbide grains during the sintering process before HPHT exposure, the diamond forms skeletal crystals which are intergrown and intertwined with the individual carbide grains as well. The result is a unique microstructure which gives the added advantage of physical bonding/interlocking of the diamond mass into the resulting matrix. This physical bonding enhances diamond retention. By "in-situ" is meant that the diamond is formed in place within the sintered carbide matrix from the graphite particles which are originally dispersed uniformly within the matrix powder blend. Diamond is not added to the powder blend in the form of existing diamond crystals.

Figure 2:
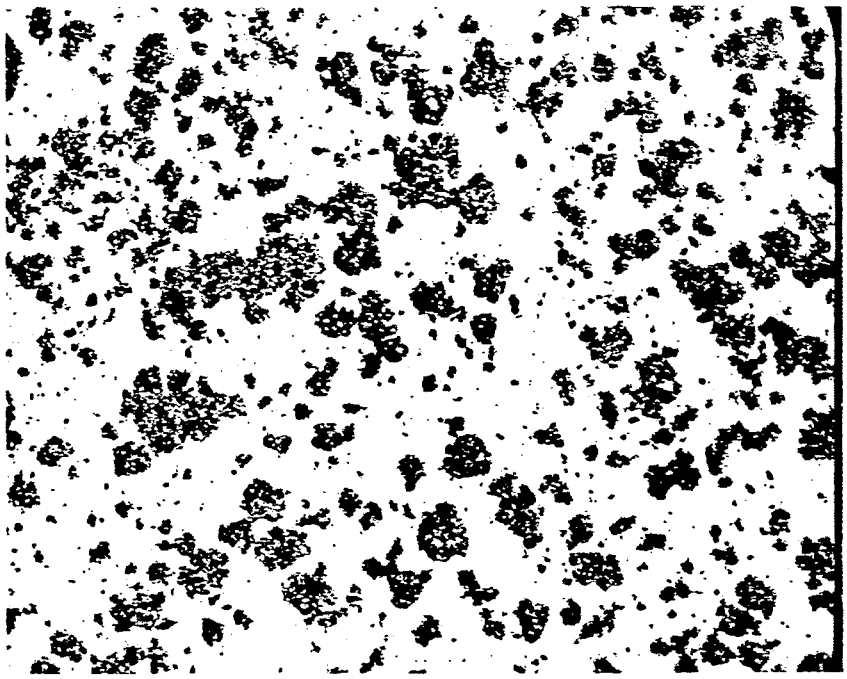
FIG. 2 is a microscopic view of a diamond impregnated carbide formed by the method of the invention, the carbide containing 40% by volume diamond after conversion, the view being taken at 200X magnification.
Figure 3:
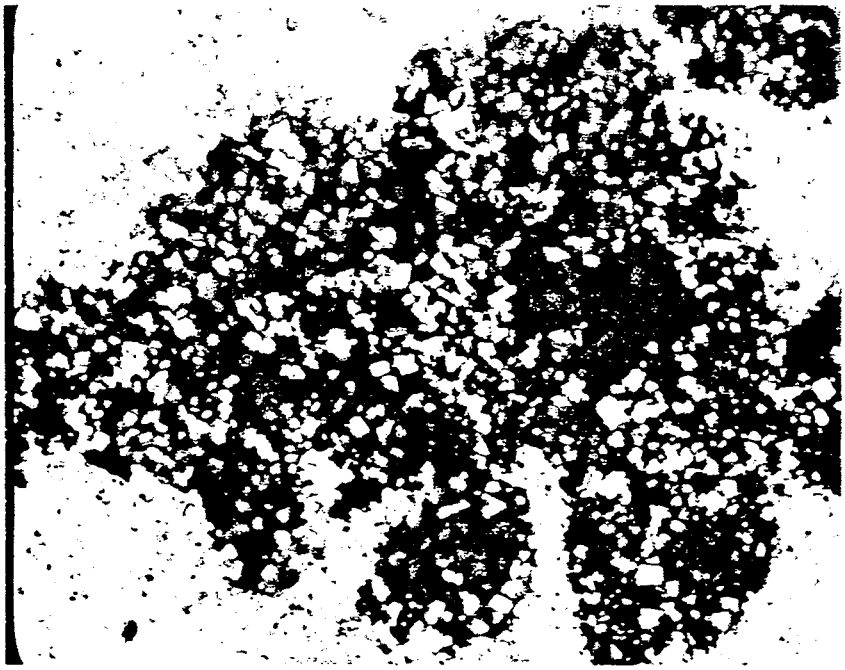
FIG. 3 is a microscopic view of the diamond impregnated carbide of FIG. 2 at 1500X magnification showing the diamond-carbide intermingling which occurs.

FIG. 2 is a microscopic view of a diamond impregnated carbide at 200X magnification formed by the method of the invention. FIG. 3 is a similar view at 1500X magnification after conversion of the graphite to diamond showing the extreme diamond-carbide intermingling.

The diamond impregnated composite so formed can then be removed from the HPHT apparatus in a step 27, cleaned to remove any salt residue, and subjected to any final finishing such as polishing or plating in a final step 29.

The following examples are intended to be illustrative of the invention:

EXAMPLE I

| | wt. % |
|---|---|
| 769 g. WC (SYLCARB SC-45/GTE SYLVANIA) | 76.9 |
| 117 g. Fe (−325 mesh/QUEBEC METAL POWDERS) | 11.7 |
| 66 g. Ni (Type 255, ALCAN) | 6.6 |
| 48 g. C (standard graphite flakes) | 4.8 |
| 20 g. Paraffin | |
| 15 g. Carbowax | |

Example I shows a typical formulation of the powder blend which is used to form the diamond impregnated composite of the invention.

The powder blend of tungsten carbide, binder and free carbon was milled in a one liter container for 24 hours at 80 rpm. Wax was added as a binder and the powders were pressed to form 10 gram compacts. The compacts were then treated as previously described to form diamond impregnated carbides.

Example II is similar to Example I but shows the use of a cobalt binder.

EXAMPLE II

| | wt. % |
|---|---|
| 698 g. WC | 69.8 |
| 222 g. Co | 22.2 |
| 80 g C | 8.0 |

20 g. Paraffin
20 g. Carbowax

Example III is a typical formulation, similar to Example II, but shows the use of an iron, nickel, cobalt binder.

EXAMPLE III 711 g. WC
132.5 g. Fe
41.4 g. Ni
33.1 g. Co
82.0 g. C.
20 g. paraffin
20 g. Carbowax Example IV shows the use of a nickel-cobalt binder.

EXAMPLE IV 36.3 g. C (Standard Production Graphite Flakes)
89.0 g. Ni (Type 255, ALCAN)
89.0 g. Co (Afrimet extra-fine)
785.7 g. WC (4.0 um SYLCARB SC-45/ GTE SYLVANIA)
30.0 g. Wax (Standard Production Paraffin)
150 ml Hexane
150 ml Acetone
5.0 kg WC Attritor Balls
Mill Time: 16 hrs
Mill Speed: 80 rpm The components were formulated to achieve a 25 vol. % 50 Ni/50 Co ratio with 20 vol. % C. The compacts which were formed were treated as previously described to form diamond impregnated carbides.

An invention has been provided with several advantages. The method uses commercially available starting materials including tungsten, or any other metal carbide powder, elemental powders of nickel, cobalt and iron, or other known graphite to diamond catalysts, and graphite powder. All of these materials are readily available. A dense sintered body is created from a blend of these powders and complex shapes can be formed using standard tungsten carbide powder processing techniques. These dense sintered bodies are then placed in an HPHT apparatus where the graphite is converted "in-situ" into diamond with no other shape change than slight shrinkage of the part owing to the conversion process. Because standard tungsten carbide powder processing techniques are utilized, any shape that can be made by such standard techniques can be made using the method of the invention. It is not necessary that the shape be limited to a shape that can be formed in the HPHT press. Because the original graphite grains are intimately intergrown and intertwined with individual tungsten carbide grains during the sintering process before HPHT exposure, the diamond forms skeletal crystals which are intergrown and intertwined with the individual carbide grains during the ultra high temperature and pressure step. The resulting microstructure is unique to the present method and provides improved physical bonding/interlocking of the diamond mass into the matrix leading to improved diamond retention.

While the invention has been shown in only one of its forms, it is not thus limited, but is susceptible to various changes and modifications without departing from the spirit thereof.

I claim:

1. A method for forming an interdispersed diamond-carbide composite, comprising the steps of:

forming a particle blend comprised of an unsintered carbide matrix having free carbon added thereto in the form of graphite, the carbide matrix being comprised of at least one metal carbide powder combined with elemental powder known to be a diamond catalyst, the total free carbon content of the particle blend being in the range from about 0.5 to 50 volume %, based on the total volume of the particle blend;

forming the particle blend into an unsintered body;

sintering the unsintered body to form a pre-densified body containing free carbon, the green body being sintered at a temperature between about 1200° C. and about 1500° and at a pressure between about 400 and about 30,000 psi; placing said pre-densified body into a metal container or a metal overcoat;

subjecting the sintered pre-densified body containing free carbon to temperature and pressure conditions sufficient to covert the free carbon to diamond in-situ, such temperature and pressure being in excess of about 1200° C. and 40,000 psi, respectively.

2. The method of claim 1, wherein the binder is present in the range from about 5 to 50% by volume, based on the total volume of the particle blend.

3. The method of claim 1, wherein the metal of the metal carbide powder is selected from the group consisting of W, Ti, Zr, Hf, V, Nb, Ta, Cr and Mo.

4. The method of claim 1, wherein the powder known to be a diamond catalyst is selected from the group consisting of Ni, Co, Fe, Al, B and alloys thereof.

5. The method of claim 1, wherein the particle size of the graphite particles used in forming the particle blend is in the range from about 0.2-1000 microns.

6. A method for forming an interdispersed diamond-carbide composite, comprising the steps of:

forming a particle blend comprised of an unsintered carbide matrix having free carbon added thereto in the form of graphite having a particle size in the range from about 0.2 to 1,000 microns, the carbide matrix being comprised of tungsten carbide powder combined with at least one powder known to be a diamond catalyst selected from the group consisting of nickel, cobalt and iron, the total free carbon content of the particle blend being in the range from about 0.5 to 50 volume %, based on the total volume of the particle blend, the diamond catalyst powder being present in the range from about 5 to 50% by volume of the particle blend;

forming the particle blend into an unsintered body;

sintering the unsintered body to form a pre-densified body containing free carbon, the green body being sintered at a temperature between about 1200° and 1500° and at a pressure between about 400 and 30,000 psi;

encapsulating the sintered pre-densified body within salt;

loading the encapsulated sintered body within an ultra high pressure and high temperature apparatus;

subjecting the sintered pre-densified body containing free carbon to temperature and pressure conditions within the ultra high pressure and high temperature apparatus sufficient to convert the free carbon to diamond in-situ, such temperature and pressure being in excess of about 1200° C. and 40,000 psi, respectively.

* * * * *